US007422302B2

(12) United States Patent
Tanaka

(10) Patent No.: US 7,422,302 B2
(45) Date of Patent: Sep. 9, 2008

(54) LIQUID INJECTION DEVICE, LIQUID INJECTION DEVICE CONTROL METHOD, AND CONTROL PROGRAM

(75) Inventor: Mitsuo Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 10/510,200

(22) PCT Filed: Apr. 1, 2003

(86) PCT No.: PCT/JP03/04173

§ 371 (c)(1),
(2), (4) Date: Mar. 4, 2005

(87) PCT Pub. No.: WO03/082582

PCT Pub. Date: Oct. 9, 2003

(65) Prior Publication Data

US 2005/0128239 A1 Jun. 16, 2005

(30) Foreign Application Priority Data

Apr. 1, 2002 (JP) ..... 2002-099359

(51) Int. Cl.
*B41J 29/393* (2006.01)

(52) U.S. Cl. ..... 347/19

(58) Field of Classification Search ..... 347/5, 347/7, 19, 108; 455/73, 575.1
See application file for complete search history.

(56) References Cited

U.S. PATENT DOCUMENTS 5,049,898 A * 9/1991 Arthur et al. ..... 347/19
6,247,784 B1 * 6/2001 Obana et al. ..... 347/37
6,585,298 B2 * 7/2003 Pålsson ..... 285/294.2
6,585,345 B2 * 7/2003 Kosugi ..... 347/19
6,938,976 B2 * 9/2005 Siwinski et al. ..... 347/19

FOREIGN PATENT DOCUMENTS

| | | | |
|---|---|---|---|
| JP | 10-286976 | A | 10/1998 |
| JP | 2000-85146 | A | 3/2000 |
| JP | 2000-103087 | A | 4/2000 |
| JP | 2001-158153 | A | 6/2001 |
| JP | 2001-162833 | A | 6/2001 |
| JP | 2002-52738 | A | 2/2002 |
| WO | WO 02/02337 | A1 | 7/2001 |

* cited by examiner

*Primary Examiner*—Anh T. N. Vo
(74) *Attorney, Agent, or Firm*—Sughrue Mion, PLLC

(57) ABSTRACT

As a replacement cartridge is moved closer to a wireless communication section provided on the housing of a printer, information stored in a non-volatile memory of the replacement cartridge is acquired by the wireless communication section. A CPU of the printer compares the amount of ink remaining in the replacement cartridge, obtained from the acquired information, with the amount of an ink remaining in a cartridge on a carriage which retains an ink of the same color as the color of the ink in the replacement cartridge. In the case where the ink remaining amount in the replacement cartridge is larger, the CPU decides that the cartridge should be replaced and moves the carriage in such a way that the target cartridge for replacement is positioned directly under an opening portion in the housing. This makes the cartridge replacement task easier.

17 Claims, 9 Drawing Sheets

LIQUID INJECTION DEVICE, LIQUID INJECTION DEVICE CONTROL METHOD, AND CONTROL PROGRAM

FIELD OF THE INVENTION

The present invention relates to a liquid injection apparatus, which injects a liquid, and a control method and control program for the liquid injection apparatus.

BACKGROUND OF THE INVENTION

Conventionally, there is an inkjet type printer, which prints an image or the like by injecting ink droplets on paper, as a liquid injection apparatus that injects a liquid to a target. Some inkjet type printers have a plurality of ink-retained cartridges (liquid containers) mounted on a carriage and a memory element provided on each cartridge to manage the remaining amount of the ink. Information about the color and remaining amount of the ink in the associated cartridge is stored in each memory element. Before printing takes place, the remaining amount of the ink in each cartridge is acquired from the memory element and is displayed on a monitor. Based on the displayed remaining amount of the ink, a user determines whether or not there is a possibility that the ink will run out during printing. In the case where there is a possibility that the ink will run out during printing, the user replaces the associated cartridge with a cartridge having a larger amount of ink remaining.

That is, a user first presses a replacement button provided on the printer to move the carriage at a standby position to a replacement position. Then, the user specifies a cartridge to be replaced from among cartridges mounted on the carriage based on the display on the monitor and replaces this cartridge with another one. Thereafter, as the user presses the replacement button again, the carriage returns to the standby position from the replacement position.

With the above-described printer, a user should determine whether or not a cartridge should be replaced based on the remaining amount of ink displayed on the monitor. At the time of replacing a cartridge, the user needs to press the replacement button to move the carriage from the standby position to the replacement position. Further, if the user removes a cartridge from the carriage for replacement while the printer is writing information on the remaining amount of ink or the like in the memory element of the cartridge, the information is not written in the memory element accurately. Therefore, the user should perform a cartridge replacement task while paying attention to a process executed by the printer.

As described above, conventionally, a heavy burden is put on a user in a cartridge replacement task and the replacement task is troublesome.

SUMMARY OF THE INVENTION

It is therefore an object of the present invention to provide a liquid injection apparatus that can make a replacement task for a liquid container easier and a control method and a control program for the liquid injection apparatus.

It is another object of the present invention to provide a liquid injection apparatus capable of accurately writing information in a memory element.

To achieve the objects, the present invention provides a liquid injection apparatus. The liquid injection apparatus includes a liquid container having a memory element which stores information about retained liquid, a carriage mounting the liquid container and having a liquid injection head which injects the liquid, and moving means which moves the carriage. The apparatus includes acquisition means that acquires information stored in a memory element which is equipped on a replacement liquid container replaceable with the liquid container mounted on the carriage and stores information about retained liquid; decision means which determines whether or not to replace the liquid container mounted on the carriage with the replacement liquid container, based on the information acquired by the acquisition means; and control means which controls the moving means in such a way as to move the carriage to a replacement position from a standby position in the case where the decision means has decided that replacement with the replacement liquid container should be done.

The present invention also provides a liquid injection apparatus that includes a liquid container with a memory element which stores information about retained liquid; a carriage mounting the liquid container in a detachable manner and having a liquid injection head which injects the liquid; moving means which moves the carriage; and a housing having a cover portion which covers the liquid container and the carriage in such a way as to make it impossible to replace the liquid container at a predetermined position in a moving area of the carriage. A first communication section is connected to the memory element, and information acquisition means having a second communication section communicatable in a non-contact manner is provided at a portion of the cover portion that faces the first communication section.

The present invention further provides a control method for a liquid injection apparatus which performs liquid injection while moving a carriage on which a liquid container is mounted. The liquid container has a memory element which stores information about retained liquid, and the carriage has a liquid injection head which injects the liquid. The method includes: acquiring information about a liquid, stored in a memory element equipped on a replacement liquid container replaceable with the liquid container mounted on the carriage; determining whether or not to replace the liquid container mounted on the carriage with the replacement liquid container, based on the information about the liquid in the replacement liquid container; and moving the carriage to a replacement position in the case where it is decided that the liquid container mounted on the carriage should be replaced with the replacement liquid container.

In addition, the present invention provides a control program for a computer of a liquid injection apparatus which performs liquid injection while moving a carriage on which a liquid container is nounted. The liquid container has a memory element which stores information about retained liquid, and the carriage has a liquid injection head which injects the liquid. The control program allows the computer to function as: means for acquiring information about a liquid, stored in a memory element equipped on a replacement liquid container replaceable with the liquid container mounted on the carriage; means for determining whether or not to replace the liquid container mounted on the carriage with the replacement liquid container, based on the information about a liquid in the replacement liquid container; and means for moving the carriage to a replacement position in the case where it is decided that the liquid container mounted on the carriage should be replaced with the replacement liquid container.

BRIEF DESCRIPTION OF THE DRAWINGS

FIG. 10(*b*) is a cross-sectional view of the printer in FIG. 1 when the carriage is at the standby position and a cartridge retaining black ink corresponds to an opening portion of a housing.

FIG. 10(*c*) is a cross-sectional view of the printer in FIG. 1 when the carriage is at the standby position and a cartridge retaining cyan ink corresponds to the opening portion of the housing.

DETAILED DESCRIPTION OF THE PREFERRED EMBODIMENTS

The first embodiment, which embodies the present invention, will be described below according to FIGS. 1 to 10.

Figure 1:
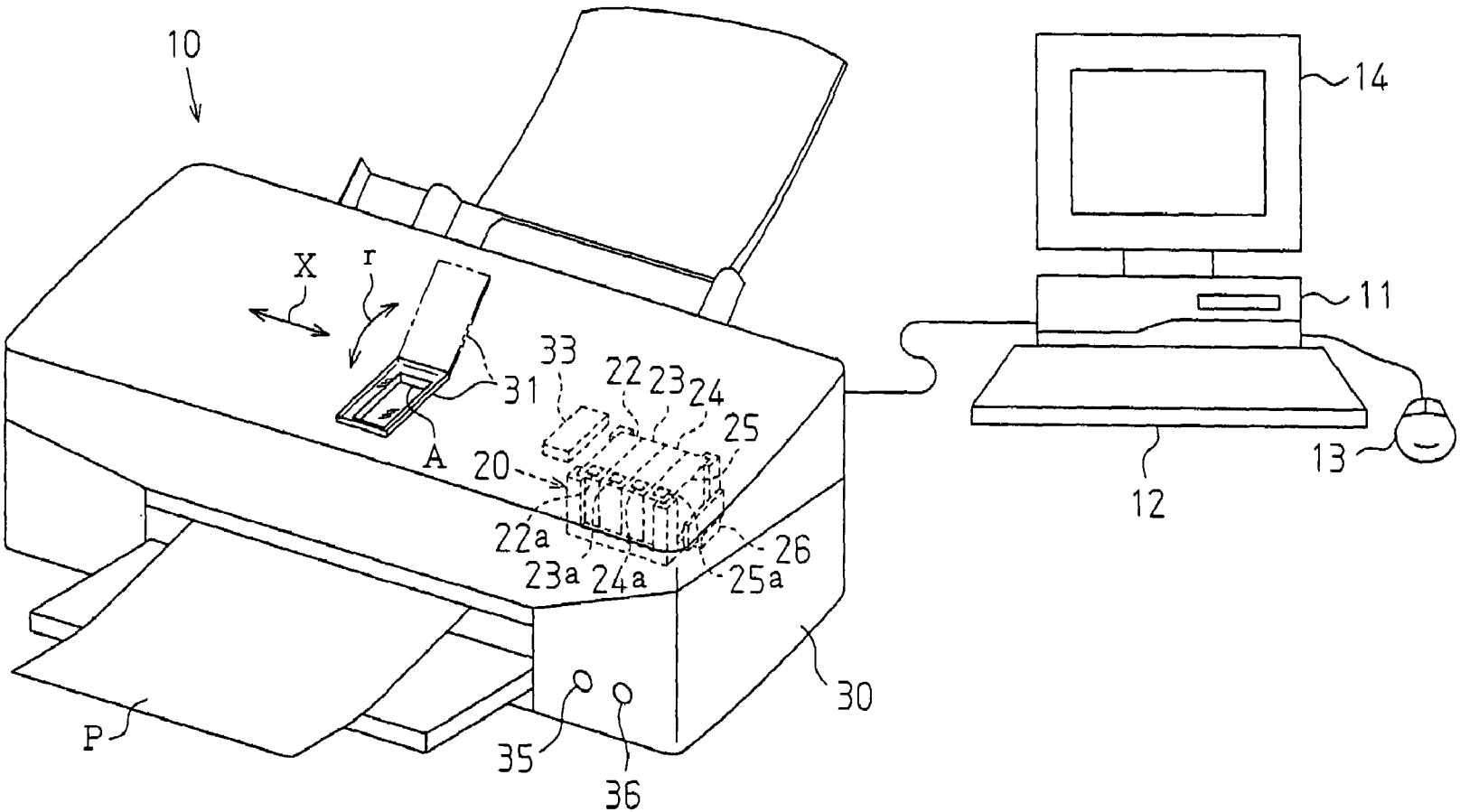
FIG. 1 is a schematic structural diagram of a printing system according to a first embodiment of the present invention.

As shown in FIG. 1, an inkjet type color printer 10 as a liquid injection apparatus is connected to a personal computer (hereinafter written as PC) 11, which is a host computer. The printer 10 and the PC 11 constitute a printing system. The PC 11 has a keyboard 12 and a mouse 13 and operates according to the operation of the keyboard 12 and mouse 13. The PC 11 has a display device, or a monitor 14, and displays necessary information on the monitor 14.

Figure 2:
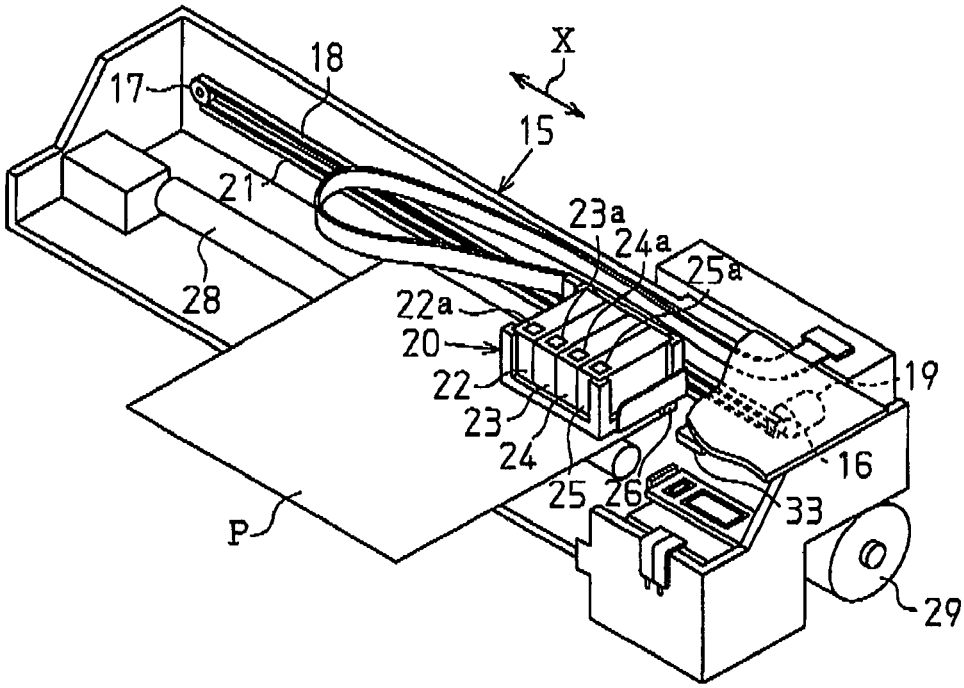
FIG. 2 is a perspective view showing the internal structure of a printer in FIG. 1.

Meanwhile, the printer 10 incorporates a frame 15 as shown in FIG. 2. A drive roller 16 and driven roller 17 are supported on the frame 15 and a timing belt 18 is laid between those rollers 16 and 17. A carriage motor 19 is coupled to the drive roller 16 and the timing belt 18 goes around as the carriage motor 19 is driven. A carriage 20 is attached to the timing belt 18. A guide shaft 21 is supported on the frame 15 in such a way as to extend in parallel to the timing belt 18. The carriage 20 is slidably supported on the guide shaft 21. In this embodiment, the drive roller 16, the driven roller 17, the timing belt 18 and the carriage motor 19 constitute moving means, which moves the carriage 20.

Figure 3:
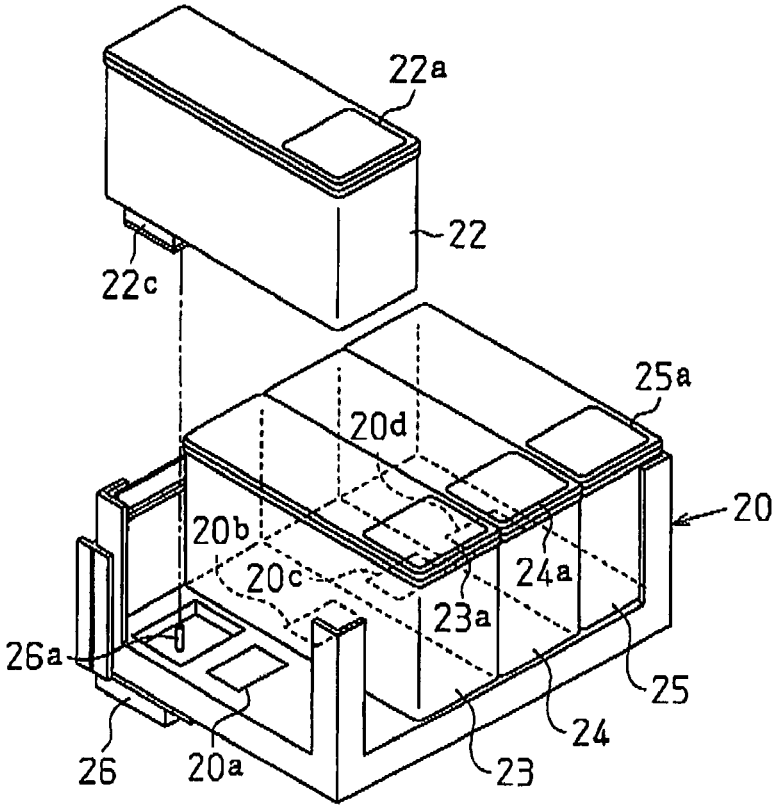
FIG. 3 is a perspective view showing a carriage in FIG. 2 and a cartridge mounted on the carriage.

A plurality of cartridges 22, 23, 24 and 25 as liquid containers are mounted on the carriage 20. Those cartridges 22, 23, 24 and 25 have the same shape, but retain inks of individual colors of cyan (C), magenta (M), yellow (Y) and black (K). As shown in FIG. 3, cartridge sensors 20*a*, 20*b*, 20*c* and 20*d*, which detect the presence/absence of the associated cartridges 22-25, are provided at the mount positions of the cartridges 22-25 in association therewith.

Each of the cartridges 22-25 has a bottom to be mounted on the cartridge mount surface of the carriage 20, a top opposite to the bottom and sides extending between the bottom and the top. The top is the side which is the rear side in the direction of mounting the cartridges 22-25 with respect to the carriage 20. An ink supply port as a liquid supply port is provided in the bottom. Although only an ink supply port 22*c* of a single cartridge 22 is illustrated in FIG. 3, similar ink supply ports are provided in the other cartridges 23-25. A plurality of ink supply needles 26*a* (only one shown in FIG. 3) protrude from the cartridge mount surface of the carriage 20 in such a way as to be respectively associated with the cartridges 22-25. When the individual cartridges 22-25 are mounted on the carriage 20, the cartridges 22-25 are connected to a recording head 26 as a liquid injection head provided at the bottom of the carriage 20 so that inks can be supplied to the recording head 26 from the cartridges 22-25 through the ink supply ports and ink supply needles.

Figure 9:
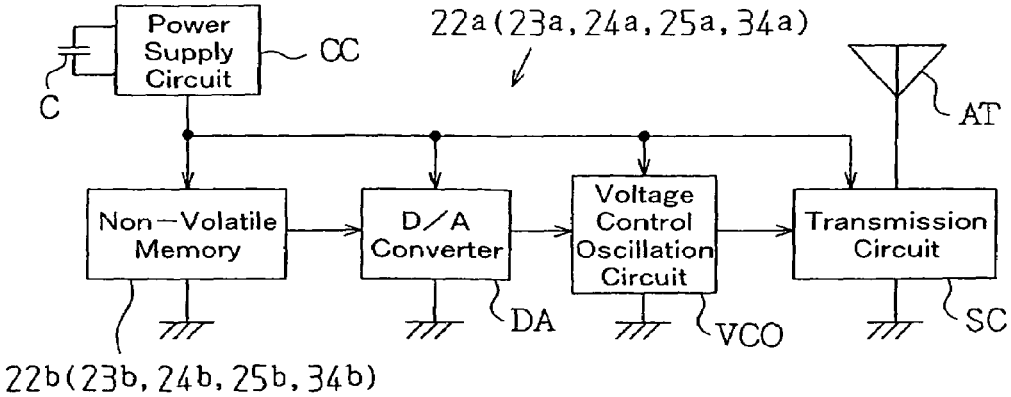
FIG. 9 is a block diagram illustrating the electric constitution of a wireless tag provided on a cartridge.

Wireless tags 22*a*, 23*a*, 24*a* and 25*a* are respectively attached to the tops of the individual cartridges 22-25. As shown in FIG. 9, the wireless tags 22*a*-25*a* have a power supply circuit CC, non-volatile memories (EEPROM) 22*b*-25*b* as memory elements, a digital-analog conversion circuit (D/A conversion circuit) DA, a voltage control oscillation circuit VCO, a transmission circuit SC and an antenna AT as a first communication section. When receiving an electromagnetic wave of a specific frequency, the power supply circuit CC, which generates power needed for the operations of the wireless tags 22*a*-25*a*, generates power based on the electromagnetic wave and charges a capacitor C with the acquired electricity. Stored in the non-volatile memories 22*b*-25*b* are information about inks retained in the associated cartridges 22-25 (ink information) and information about the associated cartridges 22-25 (cartridge information). The ink information includes the remaining amount Sc of ink and the color of the ink. The cartridge information includes the type of a cartridge, the number of times it has been attached to the carriage 20 and the production date of the cartridge. The D/A conversion circuit DA generates a control voltage in accordance with information read from the non-volatile memories 22*b*-25*b*. The voltage control oscillation circuit VCO generates a frequency signal according to the control voltage from the D/A conversion circuit DA. That frequency signal or the frequency signal indicating information read from the non-volatile memories 22*b*-25*b* is radio-transmitted via the transmission circuit SC and the antenna AT.

Figure 4:
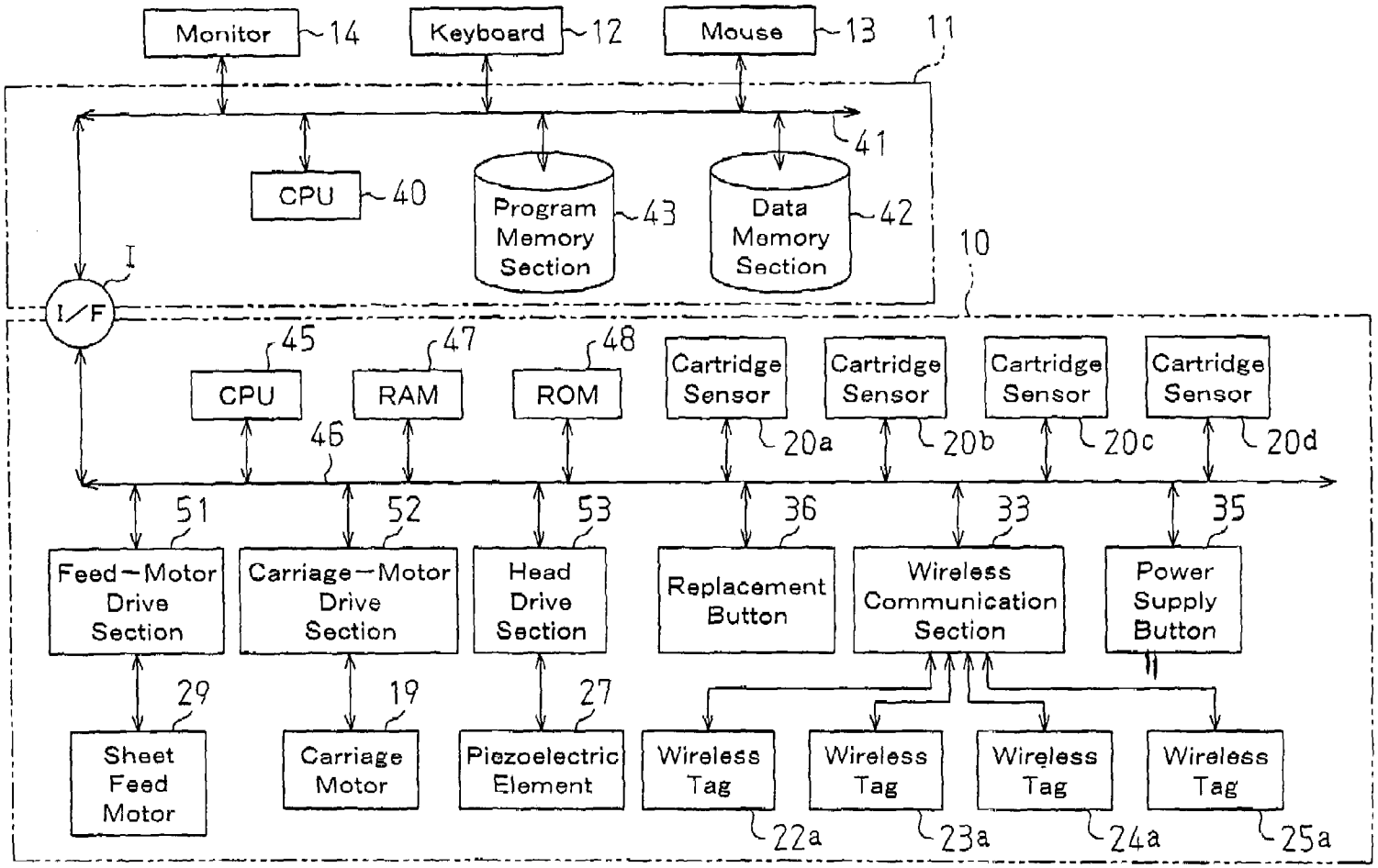
FIG. 4 is a block diagram illustrating the electric constitution of the printing system in FIG. 1.

The recording head 26 has unillustrated plural nozzles which inject inks of the individual colors supplied from the cartridges 22-25 by driving of a piezoelectric element 27 (see FIG. 4). As shown in FIG. 3, a platen 28 is supported on the frame 15 in such a way as to be positioned below the carriage 20 and a sheet feed motor 29 (see FIG. 4) is supported thereon. As the sheet feed motor 29 is driven, a sheet of paper P as a target of the injection of an ink is fed in such a way as to pass between the platen 28 and the carriage 20. At this time, the carriage 20 injects inks of the individual colors toward the sheet P from the nozzles of the recording head 26 to perform printing, while moving in an X direction (direction perpendicular to the sheet feeding direction) in FIGS. 1 and 2 with respect to the sheet P on the platen 28.

The frame 15 that supports the carriage 20 is housed in a housing 30 shown in FIG. 1. An opening portion A is formed in near the center of the top of the housing 30 in such a way as to correspond to a predetermined position in the moving area of the carriage 20. A cover 31 is rotatably attached to the housing 30 in such a way as to selectively open and close the opening portion A. The rotation direction of the cover 31 is indicated by an arrow r in FIG. 1. The cover 31 is preferably formed of a transparent material or a translucent material. The opening portion A has an area sufficient for passage of only one of the cartridges 22-25. With the carriage 20 placed at a predetermined cartridge replacement position (see FIG. 10(*b*) and FIG. 10(*c*)), in other words, with one of the cartridges 22-25 placed directly under the opening portion A, the cover 31 is rotated to open the opening portion A. Under this state, one cartridge 22-25 associated with the opening portion A can be removed from the carriage 20 through the opening portion A.

Figure 10A:
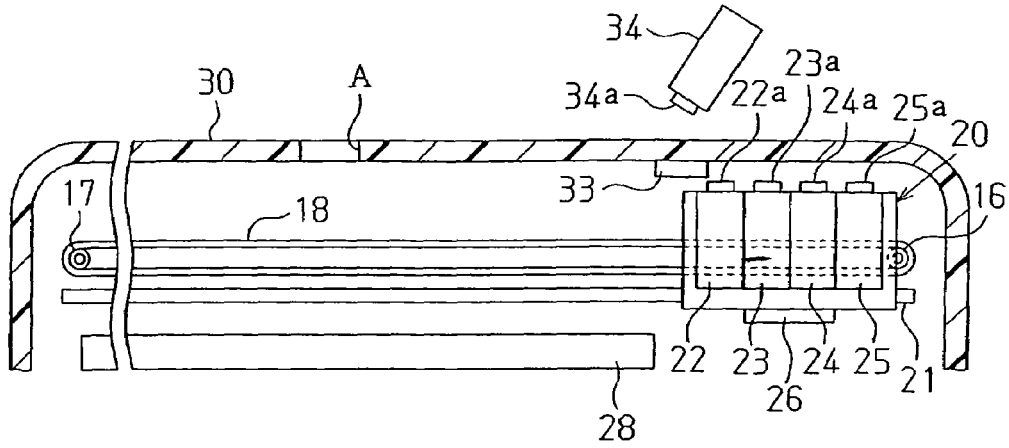
FIG. 10(*a*) is a cross-sectional view of the printer in FIG. 1 when the carriage is at a standby position.
Figure 10B:
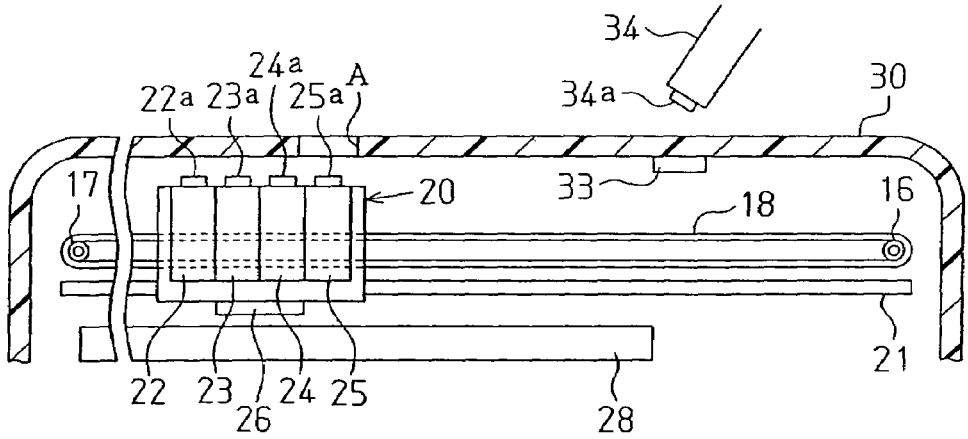
Figure 10C:
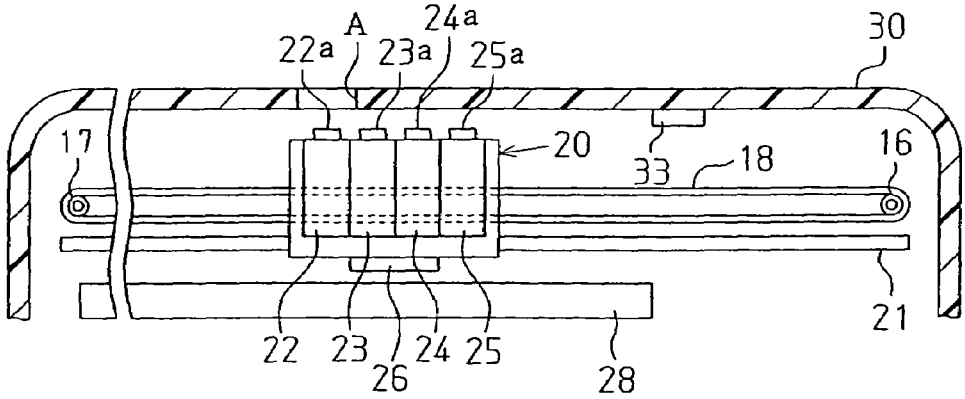

A wireless communication section 33 as acquisition means is attached to the housing 30 in such a way as to be positioned above near the end portion of the platen 28. This wireless communication section 33 is provided on the inner surface of the housing 30 in such a way as to correspond to a predetermined position in the movement area of the carriage 20. Specifically, as shown in FIG. 10(*a*), the movement area of the carriage 20 includes a print zone (first zone) set for injecting an ink toward the sheet P and a remaining non-print zone (second zone). The print zone corresponds to that portion of the moving area, which faces the platen 28. The replacement position of the carriage 20 shown in FIG. 10(*b*) and FIG. 10(*c*) is set in this print zone. The non-print zone corresponds to that portion of the movement area, which is off the platen 28. The housing 30 has a cover portion, which covers the cartridges 22-25 and the carriage 20 in this non-print zone, and the wireless communication section 33 is provided on this cover portion. In this embodiment, the cover portion of the housing 30 covers the cartridges 22-25 and the carriage 20 over the entire movement area except the opening portion A.

The carriage 20 shown in FIG. 10(*a*) is at the standby position set in the non-print zone. The wireless communication section 33 is provided in association with a position closer to the print zone than the standby position. The wireless communication section 33 is also provided in such a way as to be able to face the wireless tags 22*a*-25*a* on the individual cartridges 22-25 mounted on the carriage 20. The wireless communication section 33 irradiates an electromagnetic wave having a specific frequency in a predetermined range (e.g., several centimeters) while power is provided to the printer 10. The individual wireless tags 22*a*-25*a* generate power based on the electromagnetic wave irradiated from the wireless communication section 33. The individual wireless tags 22*a*-25*a* are driven by electricity acquired by the power generation and transmit a frequency signal indicating information read from the non-volatile memories 22*b*-25*b* to the wireless communication section 33. The wireless communication section 33 receives the frequency signal transmitted from the wireless tags 22*a*-25*a*. Though not illustrated particularly, the wireless communication section 33 has an antenna as a second communication section, which irradiates an electromagnetic wave and receives a signal.

As shown in FIG. 1, a power supply button 35 and a replacement button 36 as operation means are provided on the front side of the housing 30. The power supply button 35 is a switch button, which is operated to throw in or cut off power to the printer 10. The replacement button 36 is a switch button, which is operated at the time a user replaces the cartridges 22-25 arbitrarily. When this replacement button 36 is depressed, the carriage 20 is moved to the standby position or the replacement position directly under the opening portion A as shown in FIG. 1.

To replace the cartridges 22-25 mounted on the carriage 20, a replacement cartridge 34 having the same structure as the individual cartridges 22-25 is prepared. The replacement cartridge 34 is shown in FIG. 10(*a*) and FIG. 10(*b*). It is to be noted that the replacement cartridge 34 means a cartridge that is not mounted on the carriage 20 (i.e., unmounted cartridge) and the cartridges 22-25 before being mounted on the carriage 20 are to be treated as the replacement cartridge 34. A wireless tag 34*a* is provided on the top of the replacement cartridge 34. The wireless tag 34*a* has the same structure as the wireless tags 22*a*-25*a* on the cartridges 22-25 and information of the same kind as the information to be stored in the non-volatile memories 22*b*-25*b* of the wireless tags 22*a*-25*a* is stored in its non-volatile memory 34*b* (see FIG. 9).

Next, the electric constitution of the printing system will be described referring to FIG. 4.

As shown in FIG. 4, the PC 11 has a CPU (hereinafter written as PC-CPU) 40. This PC-CPU 40 is connected to the keyboard 12, the mouse 13 and the monitor 14 via a bus line 41. The PC-CPU 40 is connected to an unillustrated RAM and ROM. The RAM temporarily stores information such as numerical values computed by the PC-CPU 40 and the ROM is storing information such as numerical values needed for processes the PC-CPU 40 executes.

The PC-CPU 40 is connected to a data memory section 42 and a program memory section 43 via the bus line 41. Document data and image data are stored in the data memory section 42.

A printer driver program and a printing application program, which are read from an unillustrated storage medium, such as CD-ROM, and installed, are stored in the program memory section 43. The printer driver program is a program, which converts print data that is created based on document data and image data or the like to intermediate image data processable in the printer 10 (print data composed of signals having multiple values for the individual colors of cyan, magenta, yellow and black). The printing application program is a program, which causes the PC-CPU 40 to execute a predetermined operation according to the operation by the user.

The printer 10 has a CPU (hereinafter written as printer CPU) 45, which is connected to the PC-CPU 40 via an interface I. The printer CPU 45 is a computer which functions as means for executing various kinds of processes relating to replacement of the cartridges 22-25, such as means which determines whether or not to replace a cartridge, means which controls the moving means, means which acquires information about a liquid container in the cartridge and means for displaying the information on the monitor 14. The printer CPU 45 is connected to a RAM 47 and a ROM 48 via a bus line 46. The RAM 47 temporarily saves print data received from the PC 11. Various kinds of programs, such as programs or the like for allowing the printer CPU 45 to execute various kinds of processes relating to replacement of the cartridges 22-25 and various kinds of processes relating to printing are stored in the ROM 48. The printer CPU 45 controls the general operation of the printer 10 in accordance with the programs stored in the ROM 48.

The printer CPU 45 is connected to a feed-motor drive section 51, a carriage-motor drive section 52 and a head drive section 53. The feed-motor drive section 51 drives the sheet feed motor 29, the carriage-motor drive section 52 drives the carriage motor 19 and the head drive section 53 drives the piezoelectric element 27.

Further, the printer CPU 45 is connected to the individual cartridge sensors 20*a*-20*d*. The individual cartridge sensors 20*a*-20*d* output ON signals when the associated cartridges 22-25 are mounted on the carriage 20 and output OFF signals when they are not mounted. The printer CPU 45 determines whether or not the cartridges 22-25 are mounted on the carriage 20 based on the signals from the cartridge sensors 20*a*-20*d*.

The printer CPU 45 is also connected to the wireless communication section 33. If the individual wireless tags 22*a*-25*a*, 34*a* are present in a range where an electromagnetic wave irradiated from the wireless communication section 33 reaches (communicatable range), the wireless communication section 33 acquires information to be transmitted from the wireless tags 22*a*-25*a*, 34*a*. That is, the wireless communication section 33 acquires information in the non-volatile memories 22*b*-25*b* of the cartridges 22-25 in the order of the cartridges 22-25 that pass, at the time the carriage 20 passes the position facing the wireless communication section 33. If the replacement cartridge 34 is present in a range where an electromagnetic wave irradiated from the wireless communication section 33 outside the housing 30 of the printer 10, the wireless communication section 33 acquires information in the non-volatile memory 34*b* of the replacement cartridge 34.

The printer CPU 45 is connected to the power supply button 35 and the replacement button 36 and receives switch signals which are generated when those buttons 35, 36 are depressed.

The operation of the printer 10 according to this embodiment will be described next.

(Mounting of the Cartridges 22-25 on the Carriage 20)

At the time the printer 10 is used for the first time, the cartridges 22-25 have not been mounted on the carriage 20 yet. Therefore, in using the printer 10, first, the cartridges 22-25 are mounted on the carriage 20 according to procedures shown in a flowchart in FIG. 5.

Specifically, after providing power to the printer 10 by depressing the power supply button 35, a user moves the replacement cartridge 34 closer to the wireless communication section 33 of the printer 10. When the wireless tag 34*a* of the replacement cartridge 34 enters the communicatable range of the wireless communication section 33, as shown in FIG. 10(*a*), the wireless tag 34*a* transmits information in the non-volatile memory 34*b* from the antenna AT in response to the electromagnetic wave from the wireless communication section 33. The printer CPU 45 acquires information from the wireless tag 34*a* of the replacement cartridge 34 through the wireless communication section 33 (step S1). The printer CPU 45 discriminates the color of the ink in the replacement cartridge 34 from the acquired information and determines whether or not a cartridge retaining an ink of the same color has already been mounted on the carriage 20 (step S12). In the case where a cartridge retaining an ink of the same color is not mounted (NO in step S12), the printer CPU 45 drives the carriage motor 19 to move the carriage 20 directly under the opening portion A or to the replacement position (step S13).

Suppose that the color of the ink retained in the replacement cartridge 34 is black. In this case, in the process of step S13, as shown in FIG. 10(*b*), the printer CPU 45 moves the carriage 20 in such a way that the portion of the carriage 20 where the cartridge 25 retaining a black ink is aligned with the opening portion A (in FIG. 10(*b*), however, the cartridge 25 retaining a black ink is mounted on the carriage 20). Subsequently, the user opens the cover 31 and inserts the replacement cartridge 34 into the housing 30 through the opening portion A and mounts it on the carriage 20. In other words, the replacement cartridge 34 is mounted on the carriage 20 as the cartridge 25. Then, the cartridge sensor 20*d* corresponding to the cartridge 25 outputs an ON signal. Based on this ON signal, the printer CPU 45 decides that the cartridge 25 retaining a black ink is mounted on the carriage 20 (step S14), and then determines whether or not all the cartridges 22-25 are mounted on the carriage 20 (step S15).

In the case where not all the cartridges 22-25 are mounted on the carriage 20 yet (NO in step S15), the printer CPU 45 waits for another replacement cartridge 34 to come into the communicatable range of the wireless communication section 33. As the user places another replacement cartridge 34 close to the wireless communication section 33, the printer CPU 45 acquires information from the non-volatile memory 34*b* of the replacement cartridge 34 through the wireless communication section 33 and repeats the processes of the steps S11 to S15.

Suppose that at this time, the replacement cartridge 34 retaining an ink of the same color as that of the cartridge already mounted on the carriage 20 has been placed close to the wireless communication section 33. In this case, a positive decision is made in the step S12 and the printer CPU 45 sends the PC 11 information indicating that a cartridge retaining an ink of the same color as that of the replacement cartridge 34 has already been mounted on the carriage 20 and information on the color of the ink of a cartridge not mounted on the carriage 20 or the like (step S16). The PC 11 creates display data and sends it to the monitor 14 based on the received information (step S17). Based on the display data from the PC 11, the monitor 14 displays the color of the ink in the replacement cartridge 34, the fact that the cartridge of that color of the ink has already been mounted and information about the ink color of an unmounted cartridge (step S18).

When the printer CPU 45 decides that all the cartridges 22-25 are mounted on the carriage 20 (YES in step S15) after steps S11 to S18 are repeated in the above-described manner, the printer CPU 45 drives the carriage motor 19 to move the carriage 20 to the standby position as shown in FIG. 10(*a*) (step S19). Then, inks of the individual colors are supplied to and filled in the individual nozzles of the recording head 26 from the individual cartridges 22-25 mounted on the carriage 20 (step S20). Thereafter, as the power supply button 35 is depressed, the power is cut off.

(Replacement of Cartridge)

When the power supply button 35 is depressed for the purpose of printing after the cartridges 22-25 are mounted on the carriage 20, the printer CPU 45 moves the carriage 20 near the wireless communication section 33 and acquires information from the individual non-volatile memories 22*b*-25*b*. That is, the printer CPU 45 acquires information in the individual non-volatile memories 22*b*-25*b* through the wireless communication section 33 in the order of the cartridges 22-25 that come close to the wireless communication section 33 described earlier. Every time printing ends, the individual non-volatile memories 22*b*-25*b* are rewritten by signals from the wireless communication section 33 and stores new ink remaining amounts computed based on the amounts of inks used in printing. Then, in case of replacing the cartridges 22-25 in use with replacement cartridges 34 to prepare for the next printing, a process is executed according to procedures illustrated in FIG. 6.

First, the user places the replacement cartridge 34 that should be apparently be replaced in such a way that its wireless tag 34*a* enters the communicatable range of the wireless communication section 33. Then, the wireless tag 34*a* transmits information in the non-volatile memory 34*b* from the antenna AT in response to the electromagnetic wave from the wireless communication section 33. The printer CPU 45 acquires information from the wireless tag 34*a*, i.e., information, such as a remaining amount Se of the ink in the replacement cartridge 34 and the ink color, through the wireless communication section 33 (step S21). Next, the printer CPU 45 compares the ink remaining amount Se in the replacement cartridge 34 with the ink remaining amount Sc in that of the cartridges 22-25 which retains an ink of the same color as that ink color (step S22). In the case where the replacement cartridge 34 retains a black ink, for example, the ink remaining amount Sc in the cartridge 25 retaining a black ink is compared with the ink remaining amount Se in the replacement cartridge 34.

In the case where the ink remaining amount Se in the replacement cartridge 34 is larger than the ink remaining amount Sc in the cartridge 25 (YES in step S22), the printer CPU 45 decides that the cartridge 25 on the carriage 20 should be replaced with the replacement cartridge 34. Then, the printer CPU 45 drives the carriage motor 19 to move the carriage 20 to the replacement position shown in FIG. 10(*b*) from the standby position shown in FIG. 10(*a*) (step S23). FIG. 10(*b*) shows an example in which a target cartridge to be replaced is the cartridge 25 retaining a black ink, and this cartridge 25 is placed directly under the opening portion A.

In the case where the ink remaining amount Se in the replacement cartridge 34 is equal to or smaller than the ink remaining amount Sc in the cartridge 25 on the carriage 20 (NO in step S22), on the other hand, the printer CPU 45 decides that the cartridge 25 need not be replaced and holds the carriage 20 at the standby position in FIG. 10(*a*). Then, the printer CPU 45 transmits information about the replacement cartridge 34, i.e., information, such as the color and the remaining amount Se of the ink in the replacement cartridge 34, to the PC 11 (step S24). The PC 11 creates display data based on the received information and sends the display data to the monitor 14 (step S25). Based on the display data received from the PC 11, the monitor 14 displays information, such as the color and remaining amount Se of the ink in the replacement cartridge 34 (step S26).

The user checks the ink remaining amount Se in the replacement cartridge 34 displayed on the monitor 14 and decides whether or not the replacement button 36 should be depressed. That is, in the case where the user dares replace the replacement cartridge 34 even if the ink remaining amount Se in the replacement cartridge 34 is less than the ink remaining amount Sc in the cartridge 25 on the carriage 20, the user depresses the replacement button 36. When recognizing the depression of the replacement button 36 (YES in step S27), the printer CPU 45 moves the carriage 20 from the standby position in FIG. 10(*a*) to the replacement position in FIG. 10(*b*) in such a way that the cartridge 25 is placed directly under the opening portion A (step S23).

The cartridge 25 is replaced with the replacement cartridge 34 through the opening portion A (step S28). Specifically, the user first rotates the cover 31 to open the opening portion A. Then, the user holds the cartridge 25 through the opening portion A and removes the cartridge 25 from the carriage 20 through the opening portion A. Then, the cartridge sensor 20*d* corresponding to the removed cartridge 25 is turned off. Subsequently, as the user mounts the replacement cartridge 34 as a new cartridge 25 on the carriage 20 through the opening portion A, the cartridge sensor 20*d* is turned on. Based on the OFF and ON of the cartridge sensor 20*d*, the printer CPU 45 decides that replacement of the cartridge 25 retaining a black ink has been completed.

In the case where the other cartridges 22-24 are to be replaced subsequently with replacement of the cartridge 25 finished and the carriage 20 being at the replacement position, the user places another replacement cartridge 34 close to the communicatable range of the wireless communication section 33. Then, the printer CPU 45 acquires information on another replacement cartridge 34 through the wireless communication section 33 (YES in step S29). Then, the printer CPU 45 compares the ink remaining amount Se in the replacement cartridge 34 with the ink remaining amount Sc in the cartridge which retains an ink of the same color as that ink color as done in the step S22. In the case where the replacement cartridge 34 retains a cyan ink, for example, the ink remaining amount Sc in the cartridge 22 retaining a cyan ink is compared with the ink remaining amount Se in the replacement cartridge 34.

In the case where the ink remaining amount Se in the replacement cartridge 34 is larger than the ink remaining amount Sc in the cartridge 22 (YES in step S30), the printer CPU 45 decides that the cartridge 22 on the carriage 20 should be replaced with the replacement cartridge 34. Then, the printer CPU 45 moves the carriage 20 to the replacement position in FIG. 10(*c*) in such a way that the cartridge 22 comes directly under the opening portion A (step S23). Therefore, the user can replace the cartridge 22 on the carriage 20 with the replacement cartridge 34 through the opening portion A in the same manner as described above (step S28).

In the case where the ink remaining amount Se in the replacement cartridge 34 is equal to or smaller than the ink remaining amount Sc in the cartridge 22 on the carriage 20 (NO in step S30), on the other hand, the printer CPU 45 decides that the cartridge 22 need not be replaced and transmits information about the replacement cartridge 34 to the PC 11 (step S31). As a result, as mentioned above, the PC 11 creates and sends display data (step S25) and the monitor 14 displays information (step S26).

In the case where only the cartridge 25 is to be replaced and the other cartridges 22-24 are not replaced, another replacement cartridge 34 should not be placed close to the communicatable range of the wireless communication section 33 until a predetermined time passes after replacement of the cartridge 25. That is, in the case where after replacement of the cartridge in step 28, information on another replacement cartridge 34 is not acquired (NO in step S29) and a predetermined time (e.g., 10 seconds) has passed (YES in step S32), the printer CPU 45 moves the carriage 20 to the standby position in FIG. 10(*a*) from the replacement position (step S33). Then, the printer CPU 45 prepares for the subsequent printing.

(Replacement of Run-out-of-ink Cartridge)

Figure 7:
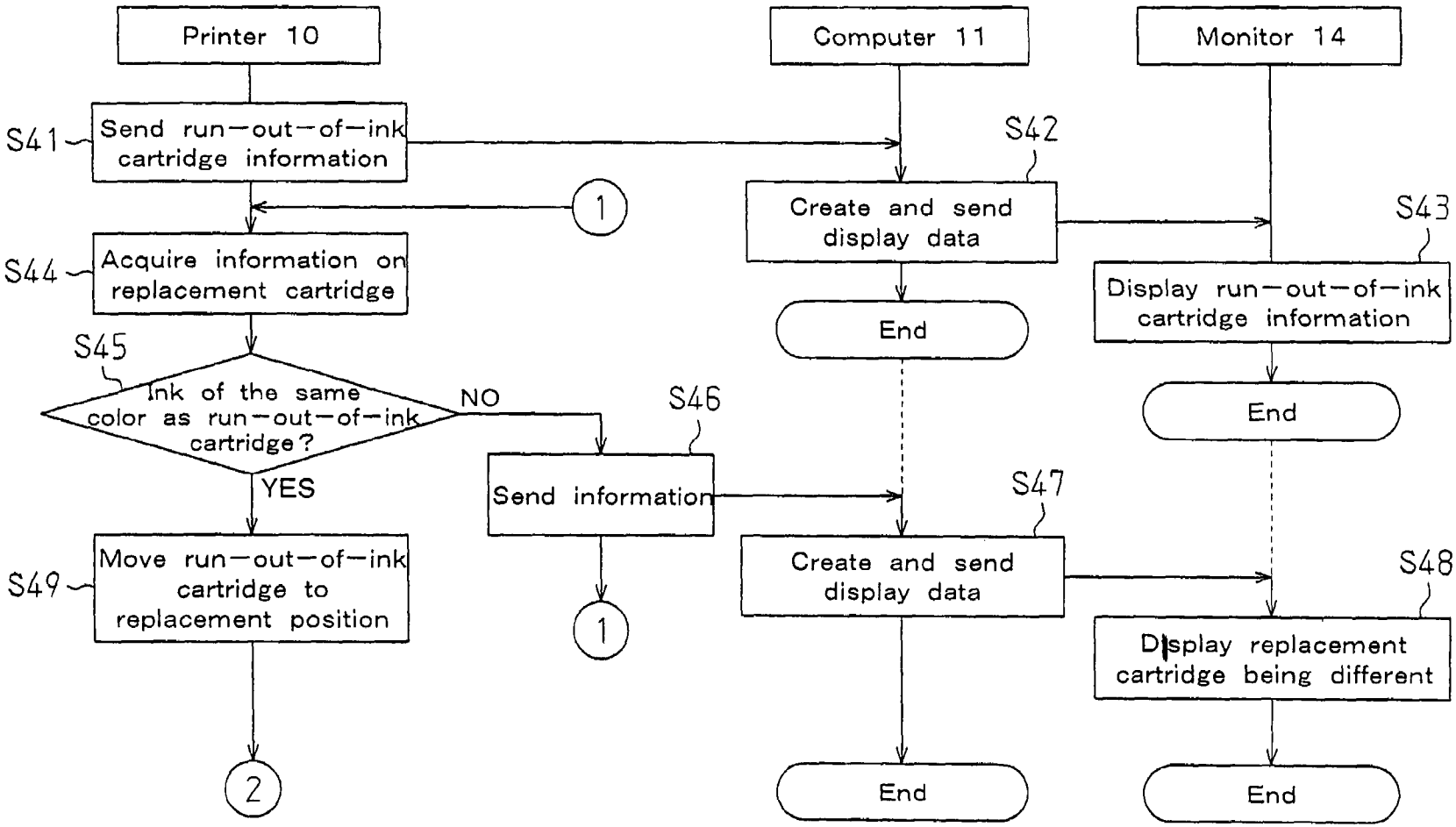
FIG. 7 is a flowchart illustrating procedures, which are executed at the time of replacing a run-out-of-ink cartridge in the printing system in FIG. 1.

Next, a cartridge replacement process, which is executed at the time the ink remaining amount Sc in the cartridges 22-25 on the carriage 20 becomes zero, will be described referring to FIGS. 7 and 8.

Before or after printing, the printer CPU 45 determines whether or not the ink remaining amount Sc acquired from each non-volatile memory 22*b*-25*b* is zero, i.e., whether or not a run-out-of-ink cartridge is present in the cartridges 22-25 on the carriage 20. In the case where there is a run-out-of-ink cartridge, the printer CPU 45 transmits information, such as the ink color and model number corresponding to the run-out-of-ink cartridge to the PC 11 (step S41 in FIG. 7). Based on the received information, the PC 11 creates and sends display data to the monitor 14 (step S42). Based on the received display data, the monitor 14 displays the information, such as the ink color and model number corresponding to the run-out-of-ink cartridge (step S43).

The user places the replacement cartridge 34 close to the wireless communication section 33 to replace the run-out-of-ink cartridge based on the information displayed on the monitor 14. Then, the printer CPU 45 acquires information in the non-volatile memory 34*b* of the replacement cartridge 34 through the wireless communication section 33 (step S44). Then, the printer CPU 45 determines whether or not the color of the ink in the replacement cartridge 34 is the same as the color of the ink corresponding to the run-out-of-ink cartridge (step S45).

In the case where the color of the ink in the replacement cartridge 34 differs from the color of the ink corresponding to the run-out-of-ink cartridge (NO in step S45), the printer CPU 45 sends the PC 11 information indicating that the replacement cartridge 34 is wrong and information on the ink color of the replacement cartridge 34, or the like (step S46). The PC 11 creates and sends display data to the monitor 14 based on the received information (step S47). Based on the received display data, the monitor 14 displays the replacement cartridge 34 being wrong and the color and the remaining amount Se of the ink in the wrong replacement cartridge 34 and displays the color and model number of the run-out-of-ink cartridge again.

In the case where the color of the ink in the replacement cartridge 34 is the same as the color of the ink corresponding to the run-out-of-ink cartridge (YES in step S45), the printer CPU 45 decides that the run-out-of-ink cartridge should be replaced with the replacement cartridge 34. Then, the printer CPU 45 moves the carriage 20 to the replacement position in such a way that the run-out-of-ink cartridge is placed directly under the opening portion A (step S49). In the case where the cartridge 25 corresponding to the black ink runs out of the ink and the color of the ink in the replacement cartridge 34 is black, for example, the cartridge 25 is moved directly under the opening portion A as shown in FIG. 10(*b*).

Figure 8:
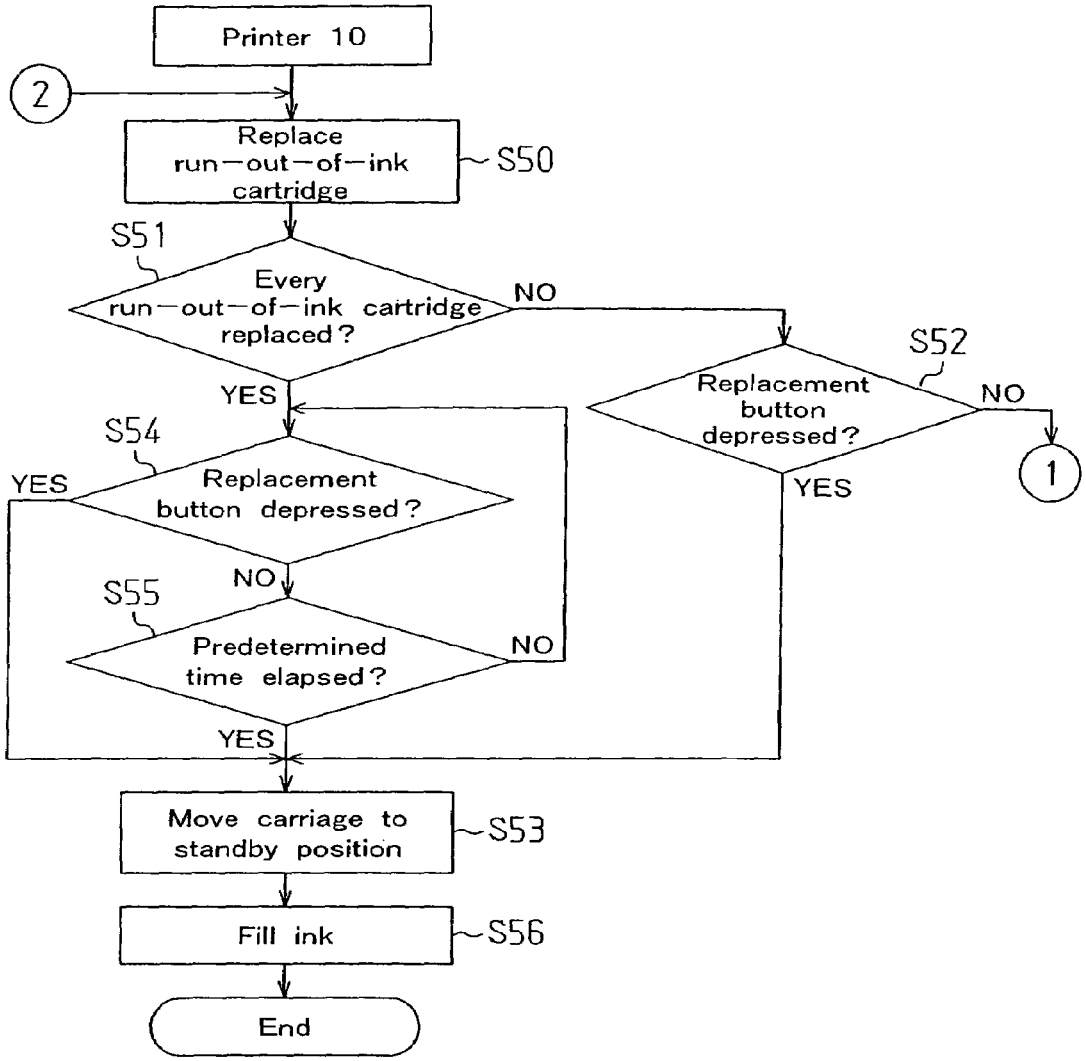
FIG. 8 is a flowchart illustrating the continuation of the procedures in FIG. 7.

Thereafter, based on the cartridge sensor 20*d* corresponding to the run-out-of-ink cartridge 25 being set on after having been temporarily turned off, the printer CPU 45 decides that replacement of the run-out-of-ink cartridge 25 has been completed (step S50 in FIG. 8). Next, the printer CPU 45 determines whether or not all the run-out-of-ink cartridges have been replaced (step S51). In the case where there still remains a run-out-of-ink cartridge (NO in step S51), the printer CPU 45 determines whether or not the replacement button 36 has been depressed by the user (step S52). In the case where the replacement button 36 is not depressed (NO in step S52), the printer CPU 45 waits for another replacement cartridge 34 to come into the communicatable range of the wireless communication section 33 with the carriage 20 being at the replacement position. Then, when another replacement cartridge 34 enters the communicatable range of the wireless communication section 33, the printer CPU 45 executes step S44 and the subsequent process in FIG. 7 again.

Meanwhile, in the case where the replacement button 36 is depressed (YES in step S52) with a run-out-of-ink cartridge still remaining (NO in step S51), the printer CPU 45 moves the carriage 20 to the standby position from the replacement position (step S53) and finishes the replacement task.

In the case where all the run-out-of-ink cartridges have been replaced (YES in step S51), on the other hand, the printer CPU 45 determines whether or not the replacement button 36 has been depressed (step S54). In the case where the replacement button 36 is not depressed (NO in step S54), the printer CPU 45 determines whether or not a predetermined time has elapsed since completion of the replacement of the cartridge in the step S50 (step S55). In the case where the replacement button 36 is depressed within the predetermined time (YES in step S54), or in the case where the predetermined time has elapsed without the replacement button 36 being depressed (YES in step S55), the printer CPU 45 moves the carriage 20 to the standby position from the replacement position (step S53). At the time the carriage 20 passes the wireless communication section 33 in the process of moving to the standby position, the printer CPU 45 sequentially acquires information stored in the non-volatile memories 22*b*-25*b* and stores it in the RAM 47 to prepare for the next printing. When the carriage 20 reaches the standby position, the ink is supplied to and filled in the nozzle of the recording head 26 from the cartridge after replacement (step S56).

The printer 10 of this embodiment has the following advantages.

(1) In this embodiment, the printer CPU 45 acquires information stored in the non-volatile memory 34*b* of the replacement cartridge 34 (steps S11, S21, S44), and determines whether or not the replacement cartridge 34 should be mounted on the carriage 20 or whether or not the replacement cartridge 34 should be replaced with a cartridge on the carriage 20, based on the acquired information. Then, based on the decision, the printer CPU 45 moves the carriage 20 to the replacement position (step S13, S23, S49). That is, by merely placing the replacement cartridge 34 close to the wireless communication section 33 provided on the printer 10, the printer CPU 45 determines whether or not replacement with the replacement cartridge 34 should take place, and in the case where replacement should be made, the carriage 20 is moved to the replacement position automatically. Therefore, the burden on the user in the cartridge replacement task is light and the replacement task is easy.

(2) In this embodiment, the ink remaining amount Se of the replacement cartridge 34 is compared with the ink remaining amount Sc of the cartridge that retains an ink of the same color as the color of the ink in the replacement cartridge 34 (step S22). Then, when the ink remaining amount Se of the replacement cartridge 34 is larger than the ink remaining amount Sc as compared, the carriage 20 is moved to the replacement position automatically for replacement of the cartridge (step S23). Therefore, a cartridge whose ink remaining amount is relatively small can be replaced reliably, making it possible to reduce the possibility that the ink will run out during printing as low as possible, and wasteful replacement of a cartridge whose ink remaining amount is relatively large is not carried out, thus improving the efficiency of the cartridge replacement task.

(3) In this embodiment, if information of another replacement cartridge 34 is acquired with the carriage 20 after replacement of a cartridge being at the replacement position, it is determined whether or not the cartridge on the carriage 20 should be replaced with another replacement cartridge 34. If replacement is necessary, the carriage 20 is moved within the range of the replacement position in such a way that a cartridge which becomes a target for replacement is placed directly under the opening portion A. That is, as another replacement cartridge 34 is placed close to the wireless communication section 33 after replacement of a cartridge, the carriage 20 is moved within a relatively small range in such a way that a cartridge which becomes a new target for replacement is placed at a replaceable position. While a plurality of cartridges are consecutively replaced, the carriage 20 merely moves within a relatively small range without returning to the standby position. Therefore, a plurality of cartridges can be replaced efficiently in a short period of time.

(4) In this embodiment, replacement of a cartridge is carried out through the opening portion A of such a size as to permit the passage of only one cartridge. When the carriage 20 is moved to the replacement position, only a single cartridge to be replaced is placed directly under the opening portion A. A cartridge which is not to be replaced cannot be removed through the opening portion A. It is therefore possible to adequately carry out the cartridge replacement task.

(5) In this embodiment, in the case where the wireless communication section 33 does not receive information from another replacement cartridge 34 even when a predetermined time elapses after replacement of a cartridge, the carriage 20 at the replacement position is moved to the standby position automatically. Normally, if information from another replacement cartridge 34 is not received even when a certain period of time elapses after replacement of a cartridge, it can be considered that a user has finished the replacement task. As the carriage 20 is moved to the standby position automatically without the user's performing any special operation, the user should perform the cartridge replacement task alone. That is, the user need not perform an operation to move the carriage 20 to the standby position and the replacement position, making possible to do the replacement task more easily.

(6) In this embodiment, the replacement button 36 for moving the carriage 20 to the replacement position and the standby position is provided on the printer 10. The user can move the carriage 20 to the replacement position or the standby position arbitrarily by depressing the replacement button, thus ensuring the cartridge replacement task intended by the user. That is, in such a case where the user uses the replacement cartridge 34 with a smaller ink remaining amount Se and wants to use up the ink in that replacement cartridge 34, the user can carry out the replacement task based on his own decision different from the decision on the printer 10 side by operating the replacement button 36. The replacement task can be terminated forcibly.

(7) In this embodiment, in the case where the wireless tag 34*a* of the replacement cartridge 34 is placed close to the communicatable range of the wireless communication section 33 and the wireless communication section 33 acquires information in the non-volatile memory 34*b* of the replacement cartridge 34, the information in the non-volatile memory 34*b* is displayed on the monitor 14 (step S26). Even in the case where the carriage 20 does not move to the replacement position even when the replacement cartridge 34 is placed close to the wireless communication section 33, therefore, the user can acquire information on the ink in the replacement cartridge 34. Then, based on the acquired information, the user can know the reason why the carriage 20 does not move to the replacement position, in other words, the reason why it has been determined that replacement of a cartridge is unnecessary. Therefore, the user can easily and appropriately make a decision on as to whether to perform the replacement task using another replacement cartridge 34 or to abort the replacement task.

(8) In this embodiment, when the power supply button 35 is depressed and the printer 10 is powered on, the printer CPU 45 automatically acquires information in the non-volatile memories 22*b*-25*b* of all the cartridges 22-25. Then, when information of the replacement cartridge 34 is acquired thereafter, the printer CPU 45 soon determines whether or not replacement with that replacement cartridge 34 is necessary. Therefore, prompt replacement work can be carried out.

Figure 5:
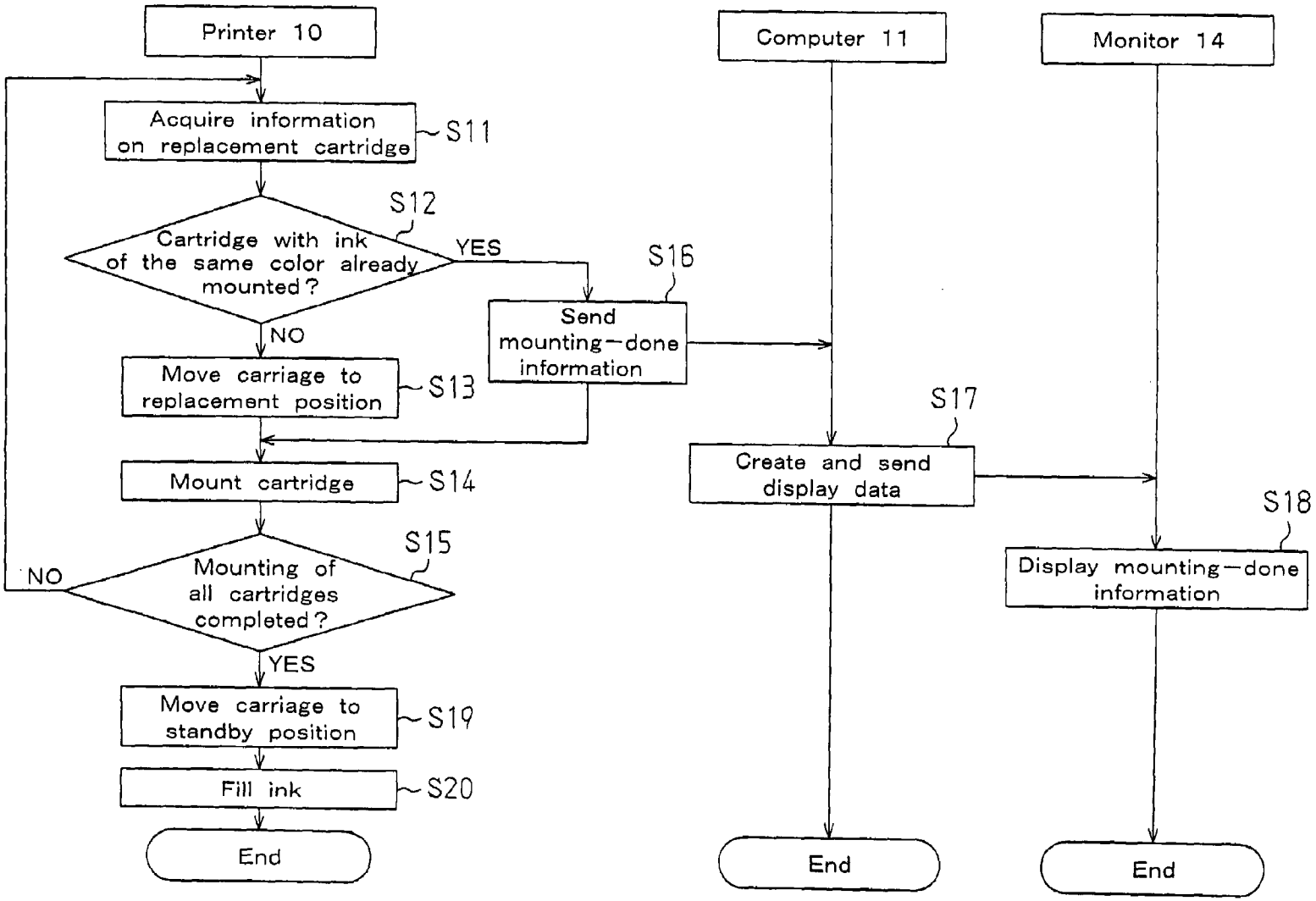
FIG. 5 is a flowchart illustrating procedures, which are executed at the time a cartridge is mounted on the carriage in the printing system in FIG. 1.

(9) In this embodiment, even at the time of mounting the cartridges 22-25 on the carriage 20, as shown in FIG. 5, merely placing a cartridge close to the wireless communication section 33 causes the carriage 20 to move in such a way that the portion of the carriage 20 where that cartridge is to be mounted is placed directly under the opening portion A (step S13). Therefore, it is less likely that a cartridge is mounted at the wrong position on the carriage 20.

(10) In this embodiment, not only the mounting/unmounting of a cartridge on the carriage 20 but also replacement of a cartridge with respect to the carriage 20 can be recognized reliably based on the signals from the cartridge sensors 20*a*-20*d* provided on the carriage 20. Therefore, the mounting state and the replacement state of a cartridge with respect to the carriage 20 can be determined adequately and the printer 10 is properly operated in accordance with the current state.

(11) In this embodiment, the wireless communication section 33 is provided at the portion (cover portion) of the housing 30 which covers the carriage 20 and the cartridges 22-25 on the carriage 20, particularly, at the position that can face the antennae AT of the wireless tags 22*a*-25*a* on the cartridges 22-25. Therefore, the wireless communication section 33 can reliably and stably communicate in a state facing the wireless tags 22*a*-25*a*. The cartridges 22-25 having the wireless tags 22*a*-25*a*, which are in communication with the wireless communication section 33, are covered by the housing 30. That is, the cartridges 22-25 in communication are shielded by the housing 30 in such a way as not to receive external force, thus increasing the reliability of communication. Further, the cartridges 22-25 in communication are prevented from being removed, thus realizing more reliable communication. That is, acquisition of the information from the wireless tags 22*a*-25*a* and writing of information in the wireless tags 22*a*-25*a* are executed accurately.

(12) Each of the individual cartridges 22-25, 34 has the ink supply port 22*c* in the bottom and has the wireless tags 22*a*-25*a*, 34*a* on the top opposite the bottom. That is, the wireless tags 22*a*-25*a*, 34*a* are provided at a position as far from the ink supply port 22*c* as possible. Therefore, the possibility that the wireless tags 22*a*-25*a*, 34*a* which are electric parts are influenced by an ink or liquid is eliminated as much as possible. As the top of the cartridges 22-25, 34 is positioned on the opposite side to the bottom where the ink supply port 22*c* is located, it is easy to secure flat space for laying out the wireless tag 22*a*-25*a*, 34*a*. This is effective in improving the degree of freedom of the layout of the wireless tags 22*a*-25*a*, 34*a* and increasing the area of the antenna AT as much as possible. The increase in the area of the antenna AT improves the reliability of communication with the wireless communication section 33. Further, it is easy to secure space for laying out the wireless communication section 33 even in the inner surface portion of the housing 30 which faces the cartridges 22-25. Therefore, an antenna with a shape excellent in communication performance can be realized even in the wireless communication section 33 without imposition of layout restrictions.

The second embodiment of the present invention will be described based on FIGS. 11 and 12, centering on the differences from the first embodiment in FIGS. 1 to 10.

Figure 11:
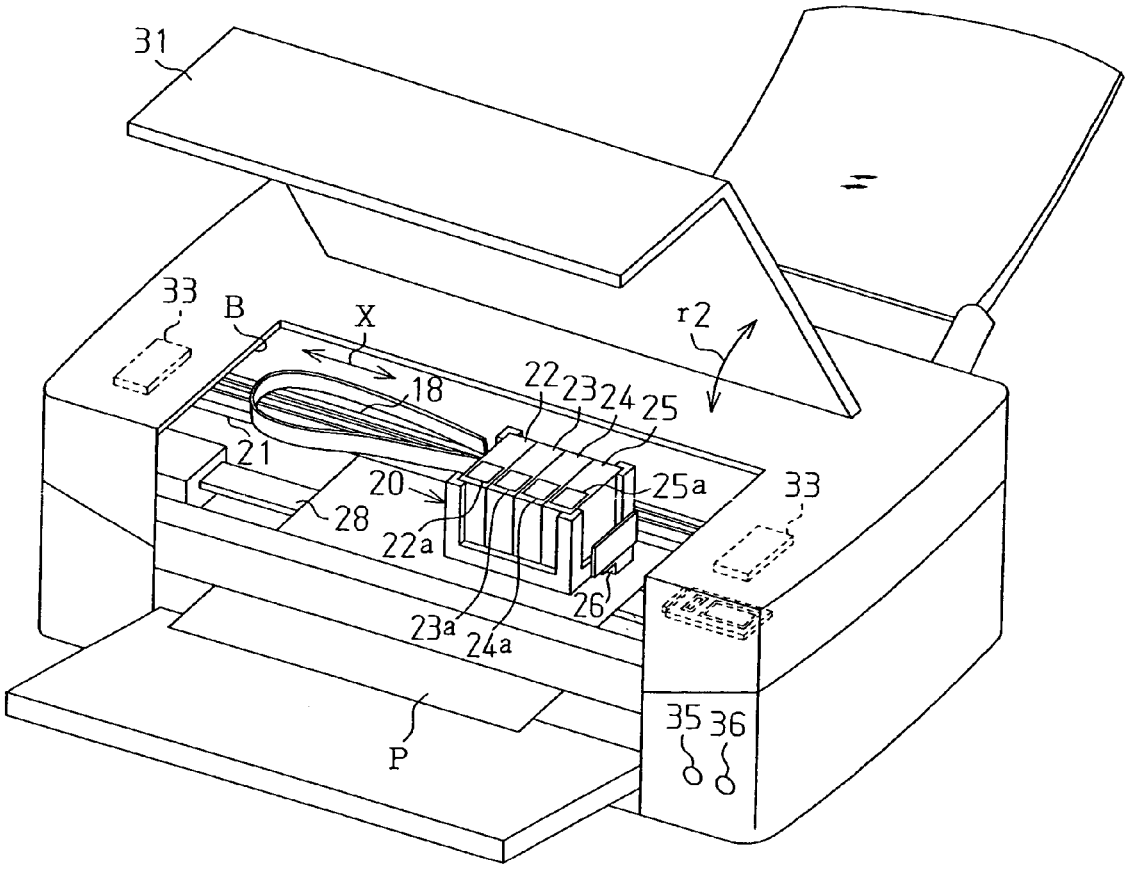
FIG. 11 is a perspective view showing a printer according to a second embodiment of the present invention.
Figure 12:
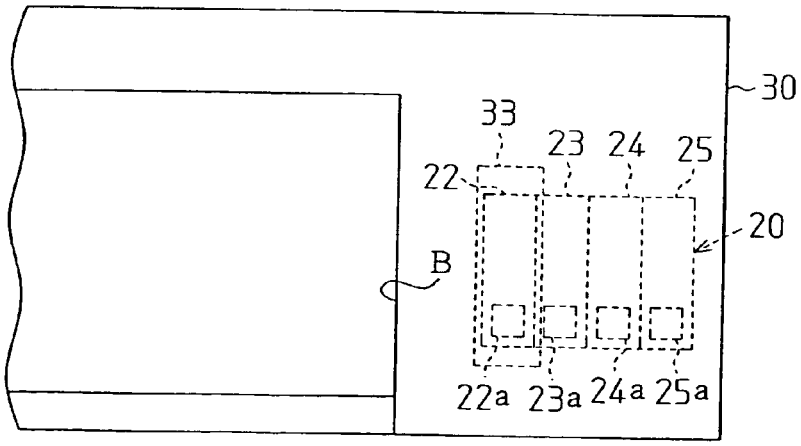
FIG. 12 is a partly plan view showing the essential portions of the printer in FIG. 11.

As shown in FIGS. 11 and 12, the printer of this embodiment has an opening portion B comparatively larger than the opening portion A provided in the printer 10 in FIG. 1. It is the same as the printer 10 of the first embodiment in other points.

The opening portion B is provided in such a way as to be able to expose nearly the entire print zone (first zone) in the moving area of the carriage 20. Only the non-print zone of the carriage 20 (second zone) is covered by the housing 30. The cover 31 formed of a transparent material or a translucent material is rotatably attached to the housing 30 in such a way as to selectively open and close the opening portion B. The rotational direction of the cover 31 is indicated by an arrow r2 in FIG. 11.

Even in this embodiment, as shown in FIG. 12, the wireless communication section 33 is provided at that portion (cover portion) of the housing 30 which covers the carriage 20 and the cartridges 22-25 on the carriage 20 in such a way as to be able to face the antennae AT of the wireless tags 22*a*-25*a* on the cartridges 22-25. With the carriage 20 at the standby position shown in FIG. 12, the wireless communication section 33 faces the wireless tag 22*a* on the cartridge 22 that is positioned closest to the print zone.

The present embodiment has advantages similar to the advantages described in (1) to (3) and (5) to (12) in the above-described first embodiment.

The individual embodiments may be modified as follows.

In the first embodiment, when the replacement button 36 is depressed, the cartridge 22-25 retaining an ink of the same color as the ink color of the replacement cartridge 34 that is acquired through the wireless communication section 33 immediately before the depression is moved directly under the opening portion A. Instead, a plurality of replacement buttons corresponding to the cartridges 22-25 may be provided so that a cartridge corresponding to a depressed replacement button is moved directly under the opening portion A. Further, a cartridge to be replaced may be selected through the screen displayed on the monitor 14 so that the selected cartridge is moved directly under the opening portion A.

In the first embodiment, the opening portion A may be formed in a size, which corresponds to the carriage 20. Even in this case, if a cartridge to be replaced is indicated by a mark such as an arrow at the replacement position, the possibility of erroneous replacement can be reduced as much as possible. The cartridges are provided with a plurality of respective lightable marks in association with the replacement position of the carriage 20. The marks corresponding to cartridges to be replaced may be lit sequentially when the carriage 20 is moved to the replacement position, so that the cartridges to be replaced can be recognized easily.

In the second embodiment, the wireless communication section 33 may be provided, instead of in one of non-print zones on both sides of the moving area of the carriage 20, in the other non-print zone. That is, the wireless communication section 33 may be provided at the position indicated by a two-dot chain line in FIG. 11. The wireless communication section 33 may be provided in each of the non-print zones on both sides.

In the first and second embodiments, the cartridges 22-25 may be detached sideways (e.g., frontward in FIGS. 1 and 11) instead of upward relative to the carriage 20. Even in this case, providing the wireless communication section 33 in such a way as to be able to face the wireless tags 22*a*-25*a* on the cartridges 22-25 can provide advantages similar to those of the individual embodiments.

In the individual embodiments, only when the ink remaining amount Se in the replacement cartridge 34 is larger than the ink remaining amount Sc in that cartridge which retains an ink of the same color as the color of the ink in the replacement cartridge 34 and is mounted on the carriage 20 (NO in step S22, S30), information on the ink in the replacement cartridge 34 is displayed on the monitor 14. Instead, in the case where information stored in the non-volatile memory 34*b* of the replacement cartridge 34 is acquired, the information may always be displayed on the monitor 14, regardless of the remaining amount of the ink.

Figure 6:
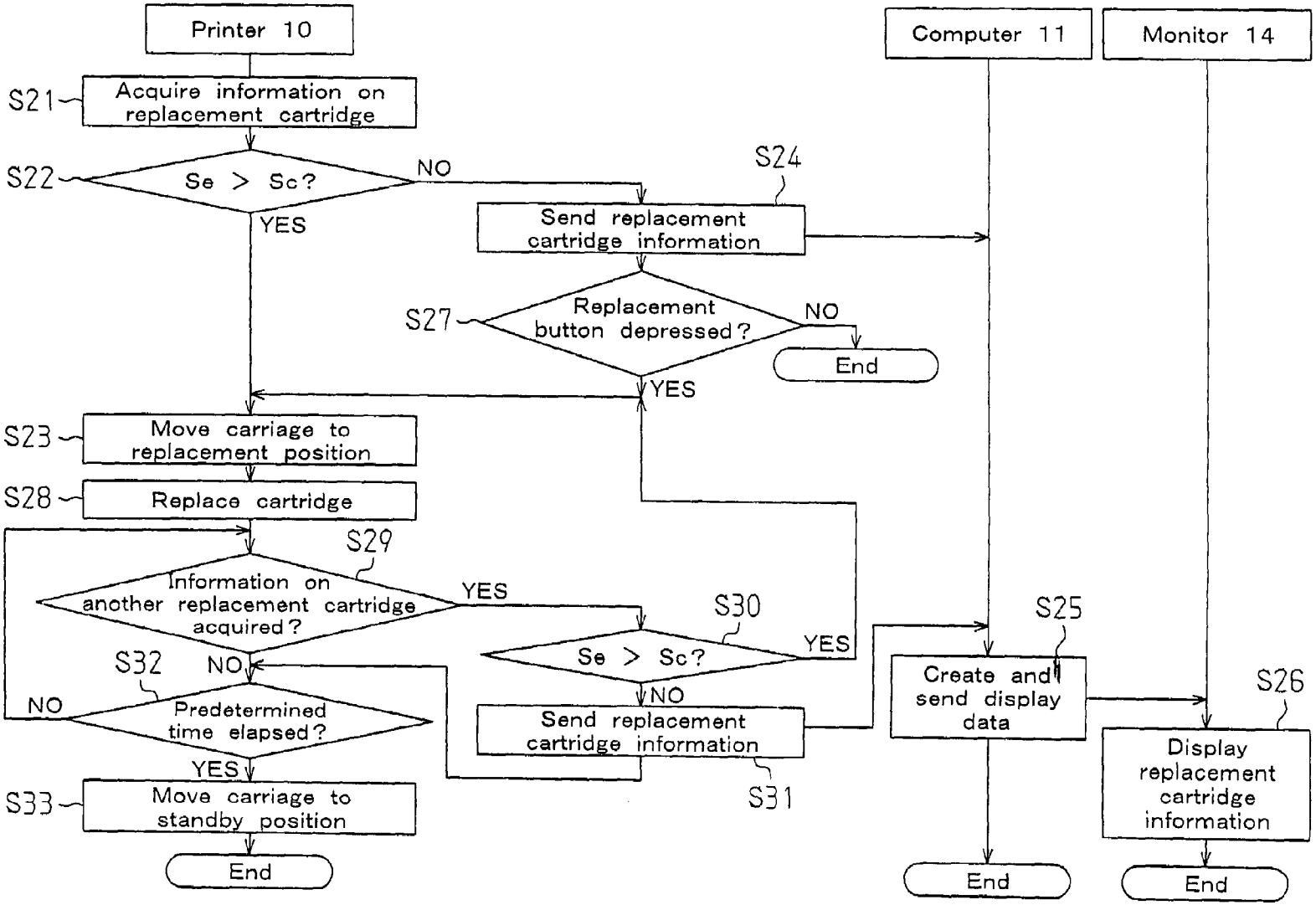
FIG. 6 is a flowchart illustrating procedures, which are executed at the time of replacing a cartridge in the printing system in FIG. 1.

In the individual embodiments, in the case where it is determined that replacement with the replacement cartridge 34 is unnecessary in the replacement procedures illustrated in FIG. 6, only information in the non-volatile memory 34*b* of the replacement cartridge 34 is displayed on the monitor 14. In this case, information on the non-volatile memories 22*b*-25*b* of the cartridges 22-25 on the carriage 20 may be displayed on the monitor 14 together with the information in the non-volatile memory 34*b* of the replacement cartridge 34.

Although the decision on whether or not a cartridge should be replaced is made based on the color and remaining amount of the ink in the individual embodiments, the production date of the cartridge and information to be acquired that is unable to be read out, for example, may be added to the conditions for the decision.

The invention claimed is:

1. A liquid injection apparatus comprising:

a liquid container having a memory element which stores information about retained liquid;

a carriage mounting said liquid container and having a liquid injection head which injects said liquid;

a moving mechanism which moves said carriage;

an acquisition device that acquires the information stored in said memory element of the liquid container mounted on the carriage and information stored in a memory element which is provided in a replacement liquid container replaceable with the liquid container mounted on the carriage and stores information about retained liquid, wherein a first communication section is connected to each memory element, and wherein the acquisition device has a second communicaton section communicatable with each first communication section in a non-contact manner for acquiring the information stored in each memory element;

a determining section which determines whether or not to replace said liquid container mounted on said carriage with said replacement liquid container, based on the information acquired by said acquisition device; and a control section which controls said moving mechanism in such a way as to move said carriage to a replacement position from a standby position in the case where said determining section has determined that replacement with said replacement liquid container should be performed.

2. The liquid injection apparatus according to claim 1, wherein a color and remaining amount of liquid retained in the corresponding liquid container are stored as said information in each said memory element, and said determining section determines that the liquid container should be replaced with said replacement liquid container in the case where the remaining amount of the liquid in the replacement liquid container is larger than a remaining amount of the liquid in the liquid container which is mounted on said carriage and retains a liquid of the same color as that of the liquid in said replacement liquid container.

3. The liquid injection apparatus according to claim 1, wherein a plurality of liquid containers are mounted on said carriage, and after one of said liquid containers mounted on said carriage has been replaced with said replacement liquid container, when said acquisition device further acquires information from a memory element provided in another replacement liquid container while the carriage is at the replacement position, said control section controls said moving mechanism to replace with said another replacement liquid container one of the liquid containers on the carriage that retains a liquid of the same color as the liquid in said another replacement liquid container.

4. The liquid injection apparatus according to claim 1, wherein in the case where said acquisition device has not acquired information from a memory element provided in another replacement liquid container after a predetermined time has passed since replacement of the liquid container on said carriage with said replacement liquid container at said replacement position, said control section controls said moving mechanism in such a way as to move said carriage at said replacement position to said standby position.

5. The liquid injection apparatus according to claim 1, further comprising operation portion which is operated to drive said moving mechanism arbitrarily to move said carriage to said replacement position and said standby position regardless of a determination by said determining section.

6. The liquid injection apparatus according to claim 1, further comprising display control section for displaying on a display device information stored in the memory element in said replacement liquid container, acquired by said acquisition device.

7. The liquid injection apparatus according to claim 1, further comprising:

a housing having a cover portion which covers both said liquid container and said carriage in such a way as to make said liquid container irreplaceable at a predetermined position in a moving area of said carriage, wherein the acquisition device is provided at a portion of said cover portion that faces said first communication section.

8. The liquid injection apparatus according to claim 7, wherein said liquid container has a bottom, a top opposite to said bottom, and sides extending between said bottom and said top, a liquid supply port is provided in said bottom for supplying a liquid to said liquid injection head, and said first communication section is provided on said top.

9. The liquid injection apparatus according to claim 7, wherein a plurality of liquid containers are mounted on said carriage in a detachable manner, and at least the liquid container that is at a position communicatable with said second communication section is covered with said cover portion.

10. The liquid injection apparatus according to claim 7, wherein the moving mechanism moves said carriage through a movement area that includes a first zone set for injecting a liquid toward a predetermined target and a remaining second zone, and said cover portion is provided in association with said second zone.

11. A control method for a liquid injection apparatus which performs liquid injection while moving a carriage on which a liquid container is mounted, the liquid container having a memory element which stores information about retained liquid, and the carriage having a liquid injection head which injects said liquid, the method comprising:

acquiring the information stored in said memory element of the liquid container mounted on said carriage and information about a liquid, stored in a memory element equipped on a replacement liquid container replaceable with the liquid container mounted on said carriage, wherein a first communication section is connected to each memory element;

causing a second communication section to communicate with each first communcation section in a non-contact manner for acquiring the information stored in each memory element;

determining whether or not to replace said liquid container mounted on said carriage with said replacement liquid container, based on the information about the liquid in said liquid container mounted on the carriage and the information about the liquid in said replacement liquid container; and moving said carriage to a replacement position in the case where the liquid container mounted on said carriage is determined to be replaced with said replacement liquid container.

12. The method for a liquid injection apparatus according to claim 11, wherein:

a color and remaining amount of liquid retained in the corresponding liquid container are stored as said information in each said memory element, and the liquid container is determined to be replaced with said replacement liquid container in the case where the remaining amount of the liquid in the replacement liquid container is larger than a remaining amount of the liquid in the liquid container which is mounted on said carriage and retains a liquid of the same color as that of the liquid in said replacement liquid container.

13. The method for a liquid injection apparatus according to claim 11, further comprising displaying on a display device the acquired information about the liquid in said replacement liquid container.

14. A control program for a computer of a liquid injection apparatus which performs liquid injection while moving a carriage on which a liquid container is mounted, the liquid container having a memory element which stores information about retained liquid, and the carriage having a liquid injection head which injects said liquid, wherein the control program causes the computer to perform steps comprising:

acquiring the information stored in said memory element of the liquid container mounted on said carriage and information about a liquid, stored in a memory element equipped on a replacement liquid container replaceable with the liquid container mounted on said carriage, wherein a first communication section is connected to each memory element;

causing a second communication section to communicate with each first communication section in a non-contact manner for acquiring the information stored in each memory element;

determining whether or not to replace said liquid container mounted on said carriage with said replacement liquid container, based on the information about the liquid in said liquid container mounted on the carriage and the information about a liquid in said replacement liquid container; and moving said carriage to a replacement position in the case where the liquid container mounted on said carriage is determined to be replaced with said replacement liquid container.

15. The control program according to claim 14, wherein:

a color and remaining amount of liquid retained in the corresponding liquid container are stored as said information in each said memory element, and the liquid container is determined to be replaced with said replacement liquid container in the case where a remaining amount of the liquid in the replacement liquid container is larger than the remaining amount of the liquid in the liquid container which is mounted on said carriage and retains a liquid of the same color as that of the liquid in said replacement liquid container.

16. The control program according to claim 14, further comprising the step of displaying on a display device the acquired information about the liquid in said replacement liquid container.

17. A liquid injection apparatus comprising:

a liquid container having a memory element which stores information about retained liquid;

a carriage mounting said liquid container and having a liquid injection head which injects said liquid;

a moving mechanism which moves said carriage;

an acquisition device that acquires the information stored in said memory element of the liquid container mounted on the carriage and information stored in a memory element which is provided in a replacement liquid container replaceable with the liquid container mounted on the carriage and stores information about retained liquid;

a determining section which determines whether or not to replace said liquid container mounted on said carriage with said replacement liquid container, based on the information acquired by said acquisition device;

an operation portion which is operated to move said carriage to a replacement position from a standby position; and a control section which controls said moving mechanism to move said carriage to the replacement position from the standby position regardless of an operation of the operation portion when said determining section has determined that replacement with said replacement liquid container should be performed and to move said carriage to the replacement position from the standby position regardless of a determination by said determination section when the operation portion is operated.

* * * * *